United States Patent [19]

Sorenson et al.

[11] Patent Number: 4,803,314

[45] Date of Patent: Feb. 7, 1989

[54] MOMENTARY ROTARY SWITCH

[75] Inventors: Richard W. Sorenson, Avon; Milton N. Ives, Wolcott; Frank P. Sapone, Waterbury, all of Conn.

[73] Assignee: Carlingswitch, Inc., West Hartford, Conn.

[21] Appl. No.: 83,939

[22] Filed: Jul. 30, 1987

Related U.S. Application Data

[63] Continuation-in-part of Ser. No. 945,880, Dec. 22, 1986, Pat. No. 4,748,297, which is a continuation-in-part of Ser. No. 884,545, Jul. 11, 1986, abandoned.

[51] Int. Cl.[4] ..... H01H 15/58; H01H 27/08

[52] U.S. Cl. ..... 200/11 J; 200/11 C; 200/11 K; 200/43.08

[58] Field of Search ..... 200/11 R, 11 A, 11 B, 200/11 C, 11 G, 11 J, 11 K, 16 C, 16 D, 155 R, 27 C, 277, 43.08, 294–296, 43.02, 43.04

[56] References Cited

U.S. PATENT DOCUMENTS

| | | | |
|---|---|---|---|
| 1,873,527 | 8/1932 | Anfinnsen | 200/11 J |
| 2,695,932 | 11/1954 | Jacobi et al. | 200/11 C |
| 2,834,842 | 5/1958 | LeBeau | 200/11 K |
| 3,294,929 | 12/1966 | Johnson | 200/11 J |
| 3,394,236 | 7/1968 | Grundig et al. | 200/11 J |
| 3,803,370 | 4/1974 | Garcia | 200/11 J |
| 3,974,348 | 8/1976 | Lipschutz | 200/43.08 |
| 4,345,121 | 8/1982 | Tenner | 200/43.04 |
| 4,558,193 | 12/1985 | Test | 200/43.08 |
| 4,623,763 | 11/1986 | Krause | 200/11 K |
| 4,639,562 | 1/1987 | Fredrickson | 200/43.08 |
| 4,748,297 | 5/1988 | Sorenson et al. | 200/11 J |

FOREIGN PATENT DOCUMENTS

| | | | |
|---|---|---|---|
| 2824584 | 12/1979 | Fed. Rep. of Germany | 200/11 J |

*Primary Examiner*—J. R. Scott

*Attorney, Agent, or Firm*—McCormick, Paulding and Huber

[57] ABSTRACT

A rotary key switch has a momentary action such that a lock cylinder and control member are returned to normal positions by a torsion spring provided in a central bore of the control member. The switch housing is in two parts, a lower body portion and an upper panel mounted cap portion that also supports the lock cylinder. The lower portion defines a cylindrical cavity and supports the control member on a central post that is also provided in this central bore. The housing portions are telescopically secured to one another and a stop is deformed in part by the control member and the panel mounted cap portion to positively limit the rotation of the key and lock cylinder.

35 Claims, 10 Drawing Sheets

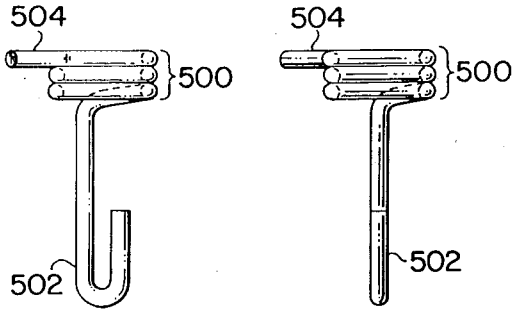
FIG. 27
FIG. 26
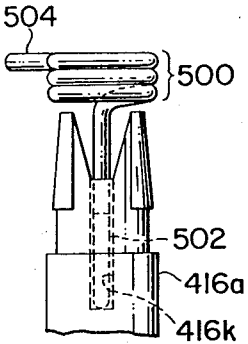
FIG. 28
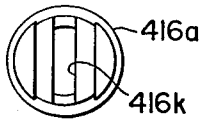
FIG. 30
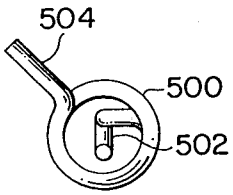
FIG. 29
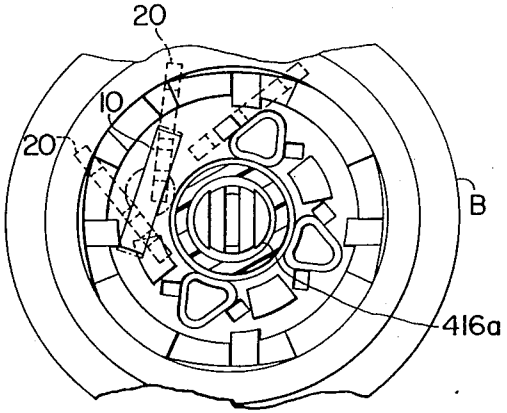
FIG. 24
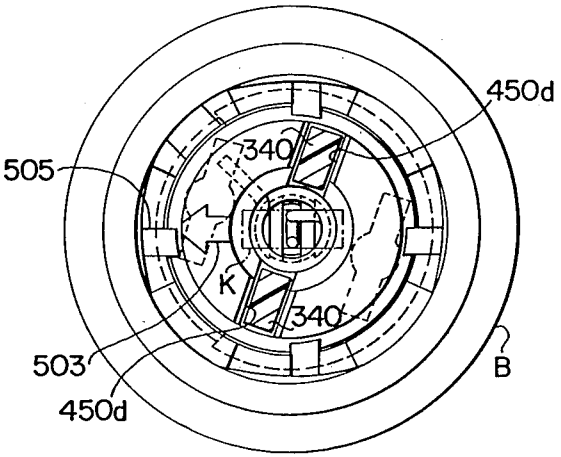
FIG. 25
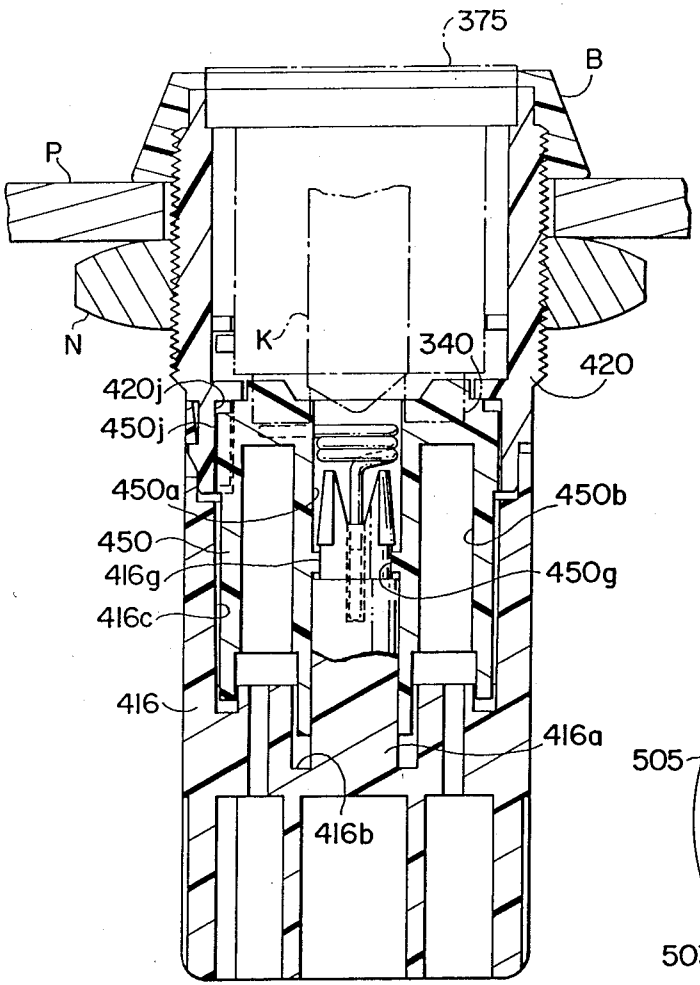
FIG. 23

MOMENTARY ROTARY SWITCH

CROSS REFERENCE TO RELATED APPLICATIONS

This application is a continuation-in-part of Ser. No. 945,880, filed Dec. 22, 1986, now U.S. Pat. No. 4,748,297 and entitled "ROTARY SWITCH", which application was in turn a continuation-in-part of an original application entitled "ROTARY SWITCH," and identified by Ser. No. 884,545, filed July 11, 1986, now abandoned. The disclosures in the above-identified applications are incorporated by reference herein.

SUMMARY OF INVENTION

This invention relates generally to rotary switches, and deals more particularly with a rotary switch of the type disclosed in the above-identified copending continuation-in-part application wherein the control member or actuator has a normal position that can be altered by rotary movement of the control member or key operated lock cylinder against the biasing force exerted by a uniquely configured torsion spring means.

In its preferred form the control member has a lock cylinder coupled with it to permit manipulation of the switch solely by means of a key fitted to that particular lock cylinder. Alternatively the control member may comprise an actuator with a manually movable portion all as shown and described in the above-identified copending continuation-in-part application.

Another object of the present invention is to provide an improved stop means for the control member, and to provide a removable bezel for the cap or upper portion of the switch housing such that this bezel can be removed and replaced with any one of a plurality of bezels depending upon the desired appearance of the switch as mounted in a panel or the like.

In accordance with the present invention a generally cylindrical dielectric body portion is provided with an upwardly open cavity of generally cylindrical shape, and a plurality of circumaxially spaced contacts are provided in the bottom wall of the cavity such that the upper ends are located between the longitudinal axis of the cylindrical cavity and the cavity side wall. A control member is rotatably received in this cavity with means provided for restraining the control member against movement axially in the cavity while permitting limited rotational movement thereof. Stop means is provided between the control member and that portion of the cylindrical switch housing which is supported in the panel.

The control member has at least one downwardly open recess spaced radially from the cavity axis by the same distance as that for the fixed contact upper ends, and a movable contact in the form of a disc is provided in this recess with spring means provided in the recess for biasing the movable contact downwardly toward the fixed contact upper ends. Thus, the movable disc contact is adapted to close adjacent fixed contacts in response to angular rotational movement of the control member. A uniquely configured torsion spring urges the control member toward a predetermined angular position so that the rotary switch exhibits a momentary action as the control member is rotated out of this predetermined position.

In the preferred embodiment the control member is coupled to a lock cylinder so that a properly configured key must be inserted into the lock cylinder to achieve rotation of the control member. The lock cylinder is held in an upper or cap portion of the housing by means described and shown in the above-identified copending continuation-in-part application.

BRIEF DESCRIPTION OF THE DRAWINGS

FIG. 23 shows a single pole momentary key switch having certain similarities to the key switch of FIG. 18. Details of the lock cylinder and key as well as details of the movable contacts and the fixed contacts have been deleted from FIG. 23 for clarity.

FIG. 24 is a plan view of the switch illustrated in FIG. 23, but with the lock cylinder and control member/actuator omitted in order to better illustrate the configuration for the bottom wall of the cavity that receives these components.

FIG. 25 is a view similar to FIG. 24 but illustrating the control member provided in its cavity and only the lock cylinder and key being omitted.

FIG. 26 is an elevational view of the torsion spring provided between the control member of the rotary switch illustrated in FIG. 23 and the central post defined by the body portion thereof.

FIG. 27 is a side elevational view of the spring illustrated in FIG. 26.

FIG. 28 is a side elevational view of the spring of FIG. 27 illustrating the spring provided in position within the slot provided for it in the post portion of the switch case body portion.

FIG. 29 is a plan view of the spring of FIG. 27.

FIG. 30 is a plan view of the post portion of FIG. 28 illustrating the slot before the torsion spring is inserted therein.

DETAILED DESCRIPTION OF FIGS. 1-14A

These views illustrate a two pole rotary switch having eight fixed terminals that are selectively interconnected in adjacent pairs by rotation of a manually operated actuator. The switch housing is of one-piece construction and includes an annular flange that permits front mounting of the switch in a panel. The actuator has a depending post that is received in a bore provided for it in the bottom wall of the switch case, and a retaining ring is provided to secure these components in assembled relationship. The actuator is held against axial movement in the cavity and limited rotation of the actuator is permitted by stop means defined in part by a lower skirt portion of the actuator and a slot provided for it in the bottom wall of the cavity.

Figure 1:
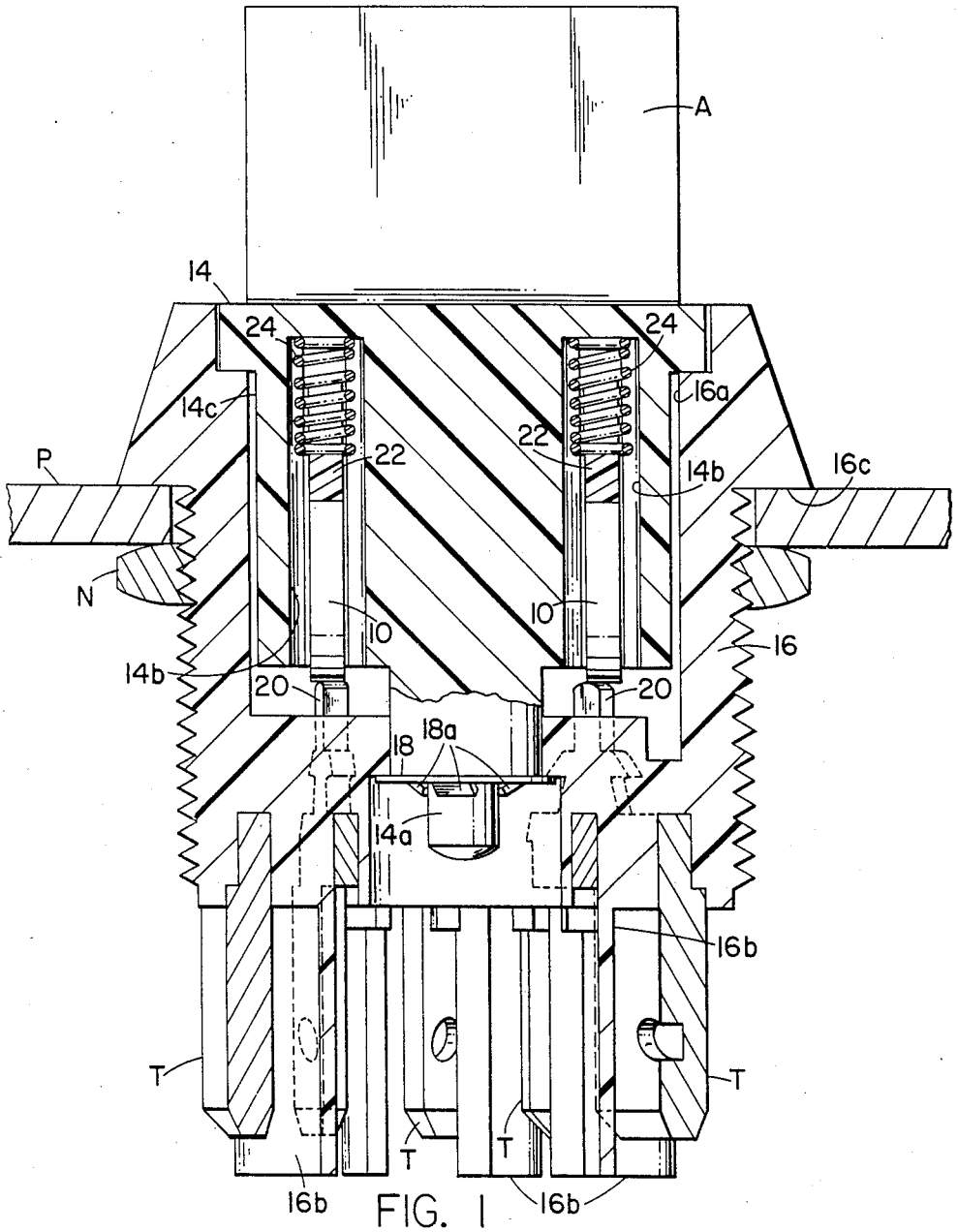
FIG. 1 shows in vertical cross section an assembled rotary switch constructed in accordance with one version of the present invention.
Figure 10:
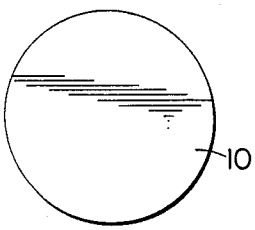
FIG. 10 is an elevational view of the movable contact disc illustrated in FIGS. 1 and 4.
Figure 6:
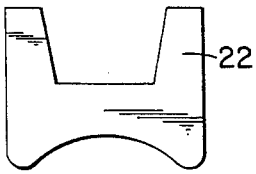
FIG. 6 is an elevational view of one element associated with the movable contact biasing means.
Figure 11:
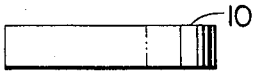
FIG. 11 is an end view of the contact disc of FIG. 10.
Figure 7:
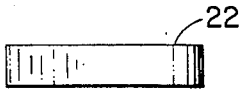
FIG. 7 is a bottom view of the element illustrated in FIG. 6.
Figure 2:
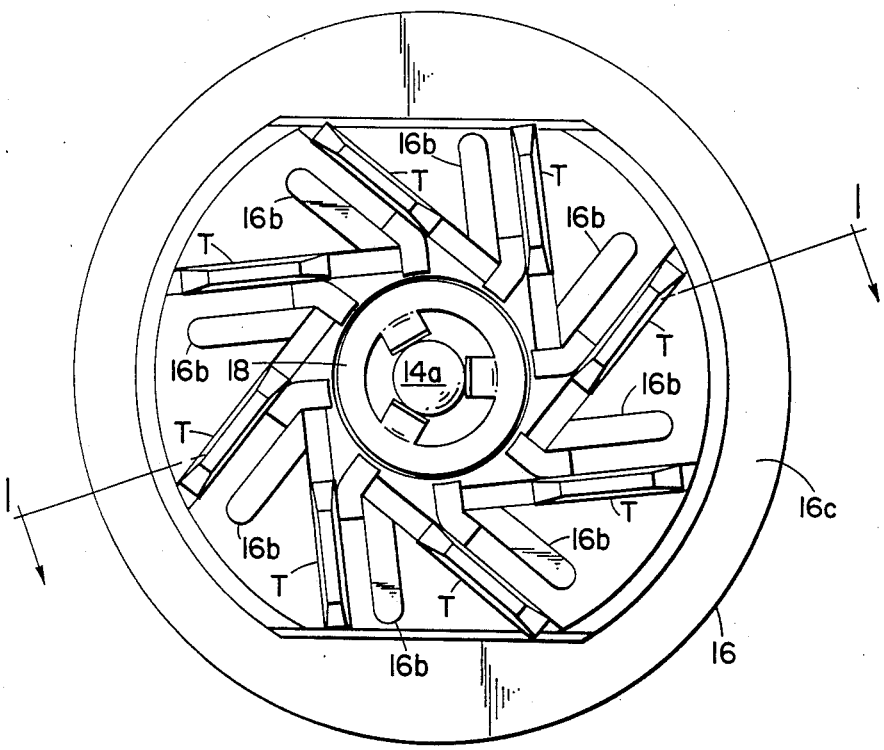
FIG. 2 is an end view showing the bottom of the switch illustrated in FIG. 1, FIG. 1 being taken generally on the line 1—1 of FIG. 2.
Figure 5:
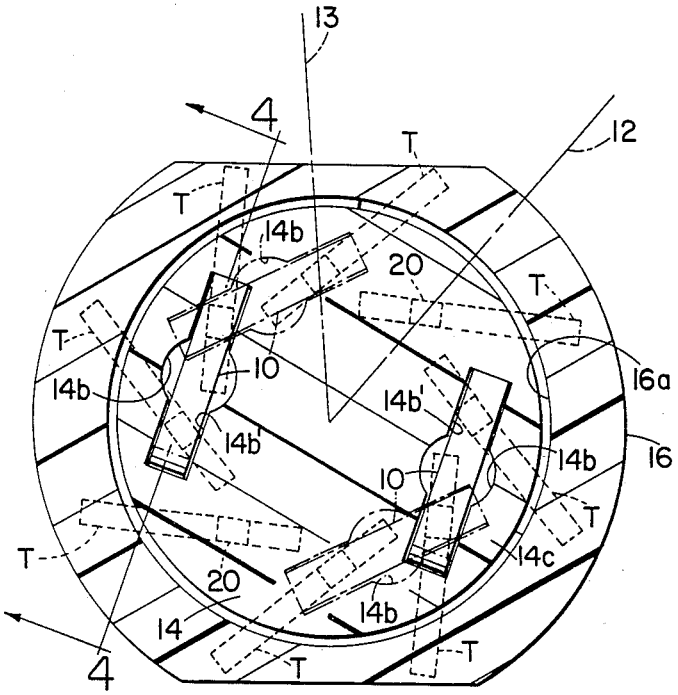
FIG. 5 is a horizontal section taken generally on the line 5—5 of FIG. 4.
Figure 3:
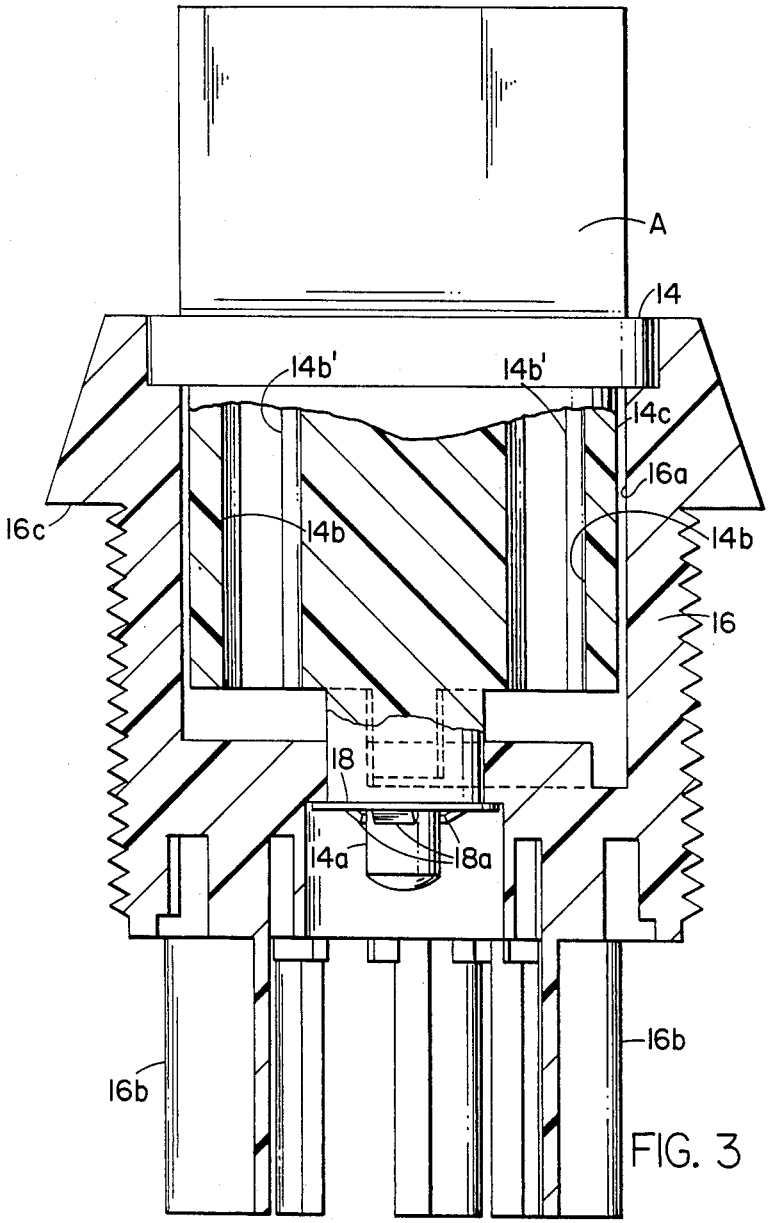
FIG. 3 is a side elevational view showing partly in section the elements of the FIG. 1 switch namely the body portion and control member or actuator, but without the metal fixed contacts and without the movable disc contacts illustrated for the switch of FIG. 1.
Figure 9:
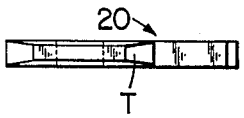
FIG. 9 is a bottom view of the fixed contact of FIG. 8.
Figure 8:
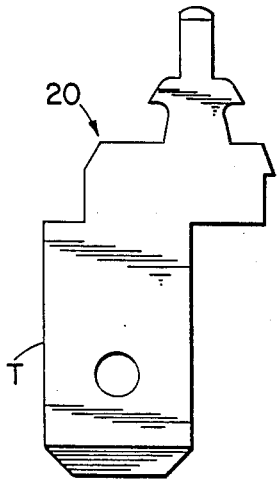
FIG. 8 is an elevational view of one fixed contact of the type used in the switch of FIGS. 1–13 inclusively.
Figure 4:
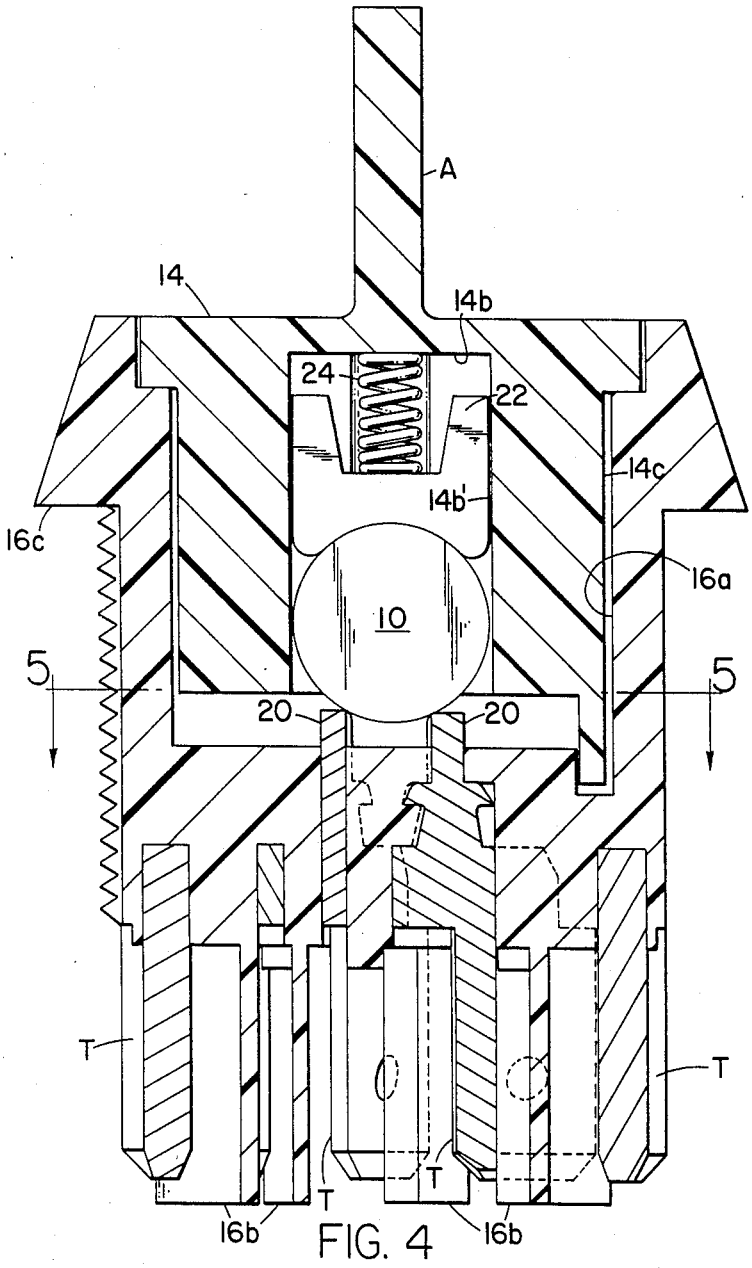
FIG. 4 is a vertical sectional view through the switch of FIGS. 1–13 inclusively being taken generally on the line 4—4 of FIG. 5.
Figure 12:
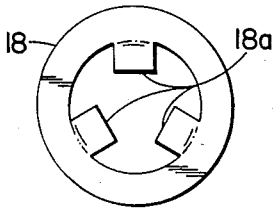
FIG. 12 is a plan view of a retaining ring used to secure the control member or actuator in the body portion as illustrated in FIGS. 1 and 3.
Figure 13:
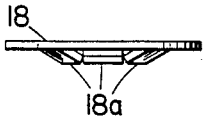
FIG. 13 is an end view of the retaining ring of FIG. 12.

In common with the momentary switch to be described a movable contact disc illustrated in detail in FIGS. 10 and 11 is provided in a downwardly open recess provided for it in the actuator. Individual springs are provided for each contact disc together with individual retainers best shown in FIGS. 6 and 7 that act upon the contact discs so that the peripheral portion of each disc rides over the upper end of each of the fixed contacts provided in the bottom wall of the switch case body portion. The fixed contacts are illustrated in FIGS. 8 an 9 and this action of the movable contact disc is best shown in FIG. 4.

Figure 14:
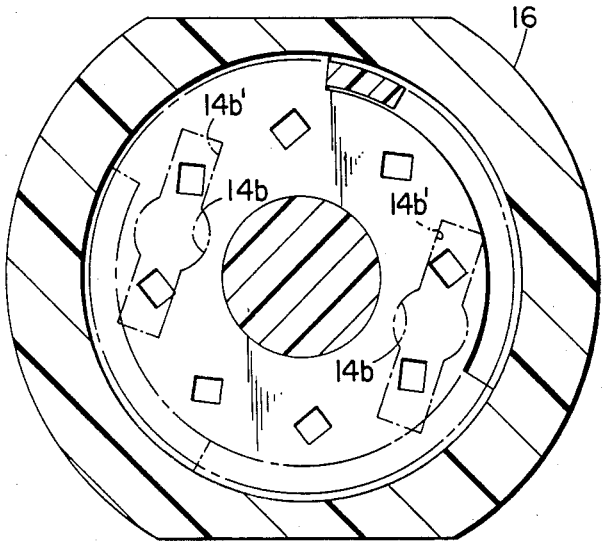
FIG. 14 is a sectional view of the switch shown in FIGS. 1–13 and illustrates a 90 degree range of rotational movement that is provided for the rotary control member or actuator as a result of the unique configuration for the stop means provided in part on the body portion and in part on the rotary control member itself.
Figure 14A:
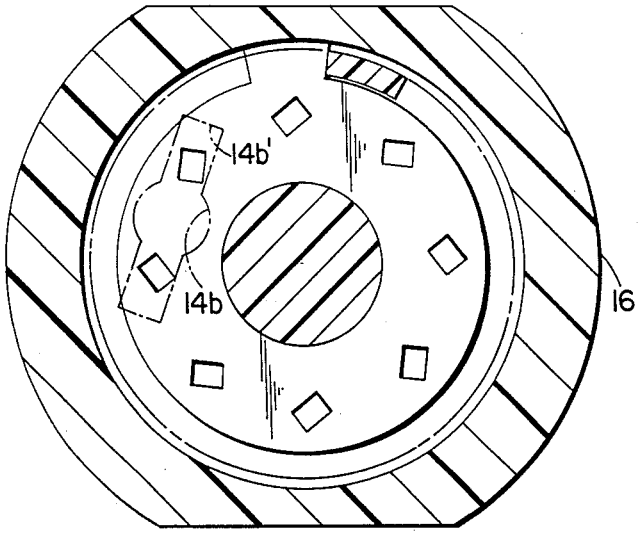
FIG. 14A shows a single pole switch with stop means for providing approximately 315 degrees of actuator rotation.

FIG. 14A shows a single pole rotary switch and the preferred embodiment to be described with reference to FIGS. 23-30 is also a single pole rotary switch. See disclosure in U.S. Pat. No. 4,748,297 for a complete description of these views as incorporated by reference herein.

DETAILED DESCRIPTION OF FIG. 15

Figure 15:
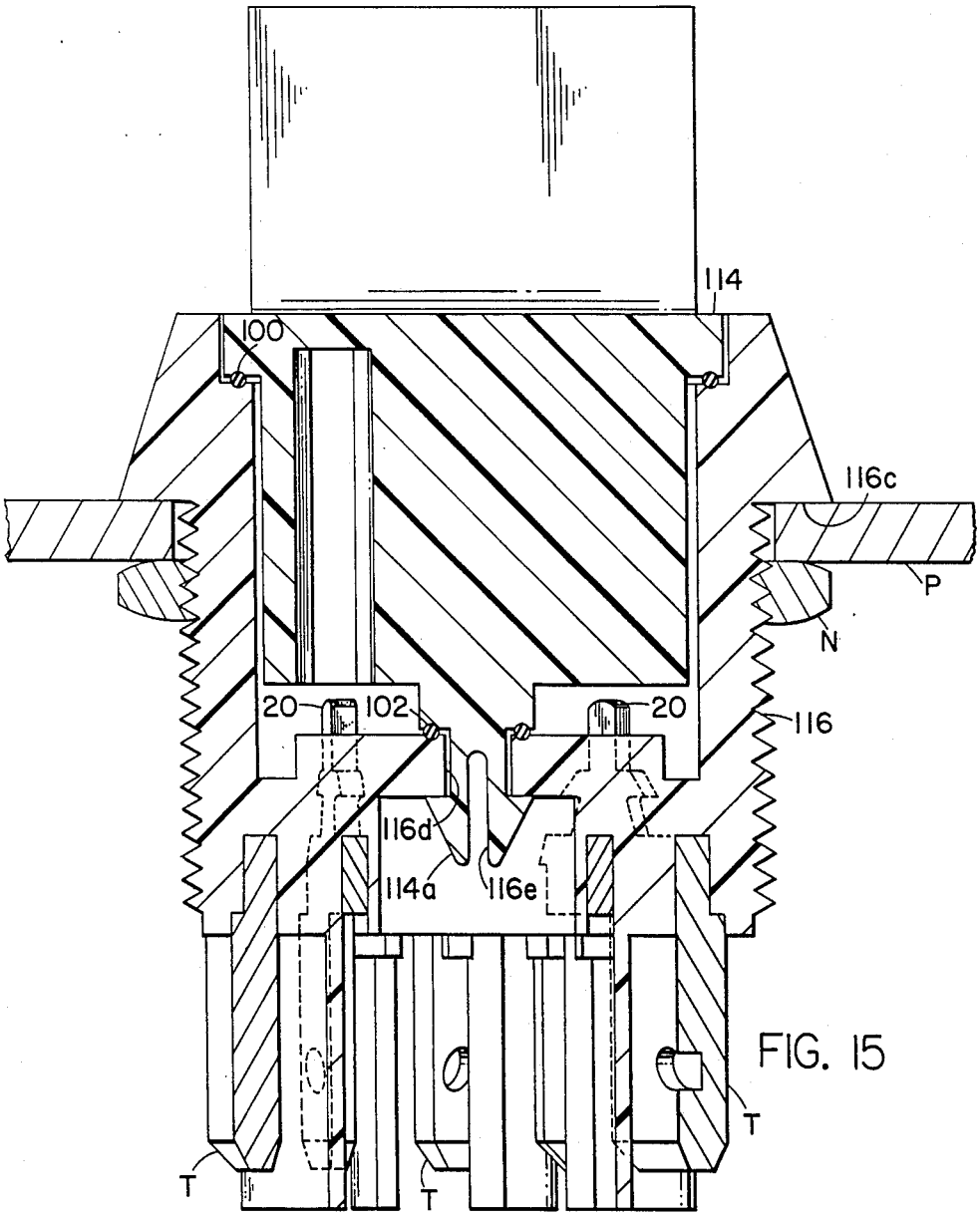
FIG. 15 is a vertical sectional view similar in many respects to the views of FIGS. 1 and 3, but illustrating a different means for interconnecting the control member or actuator with the body portion of the switch.

The switch of FIG. 15 is otherwise similar to that described with reference to FIGS. 1-14 but instead of a retaining ring provided on the depending post of the actuator to hold the actuator and switch case body portion in the assembled relationship a bifurcated post is provided with radially deformable post portions that define an upwardly facing annular flange so that upon assembly the post portions provide this flange against a downwardly facing surface on the switch case body portion to hold the actuator and body portion in assembled relationship. See the disclosure in issued U.S. Pat. No. 4,748,297 for a complete description of this view as incorporated by reference herein.

DETAILED DESCRIPTION OF FIG. 16

Figure 16:
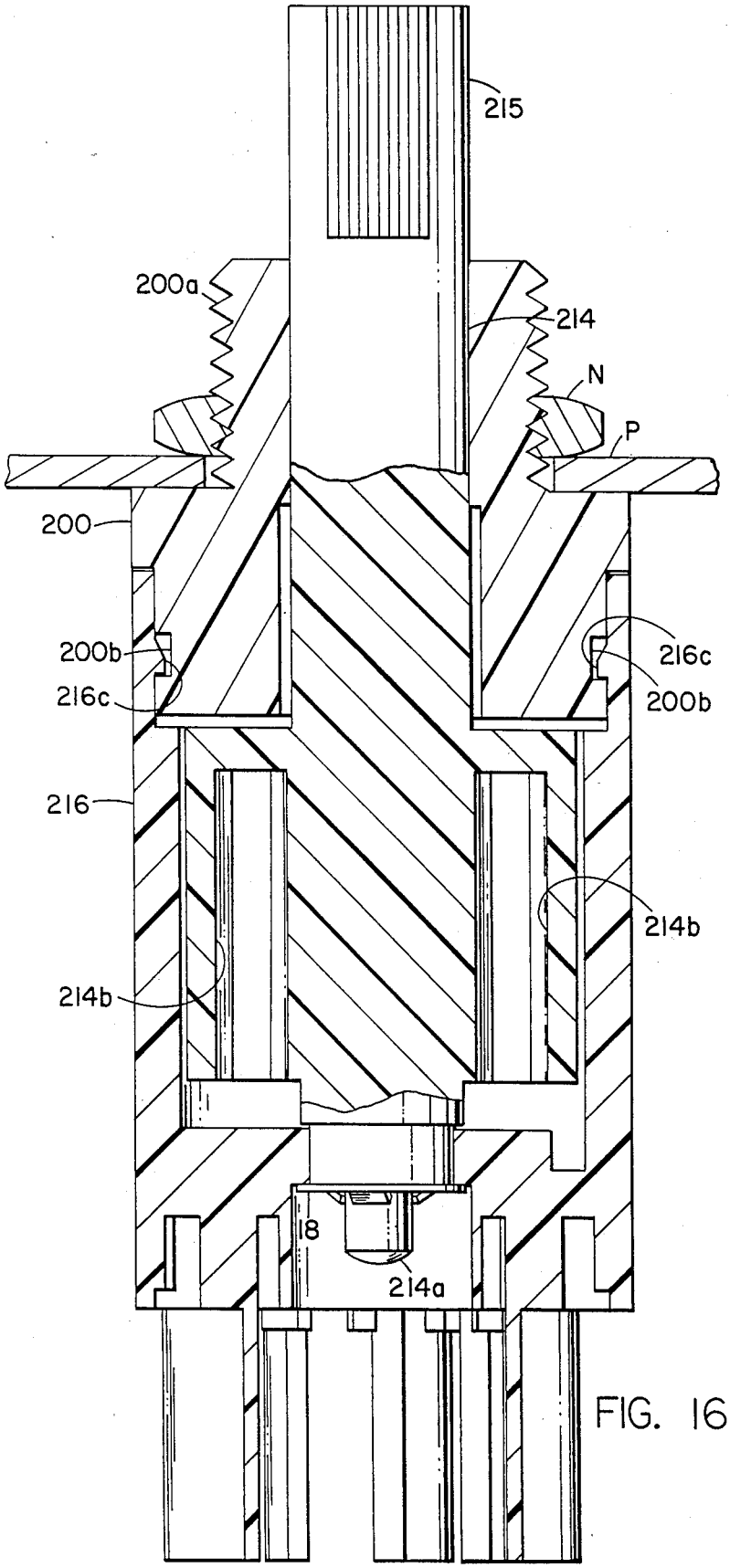
FIG. 16 is a vertical sectional view similar in many respects to that of FIG. 3 but illustrating a different configuration for the upper portion of the switch such that the body portion is defined by a cap which is assembled with the body portion to provide an upstanding boss that permits the switch to be conveniently attached to a panel, and which boss is also includes a through opening for the stem portion of the control member such that a knob or handle can be releasably secured to the stem.

FIG. 16 shows a two-piece body portion wherein the switch case also includes an upper portion assembled with the lower portion by means defined in part on each. The upper cap portion defines a boss adapted to be received in a panel opening from the rear of the panel and to be held in place by a threaded nut. See the disclosure in issued U.S. Pat. No. 4,748,297 for a complete description of this view as incorporated by reference herein.

DETAILED DESCRIPTION OF FIG. 17

Figure 17:
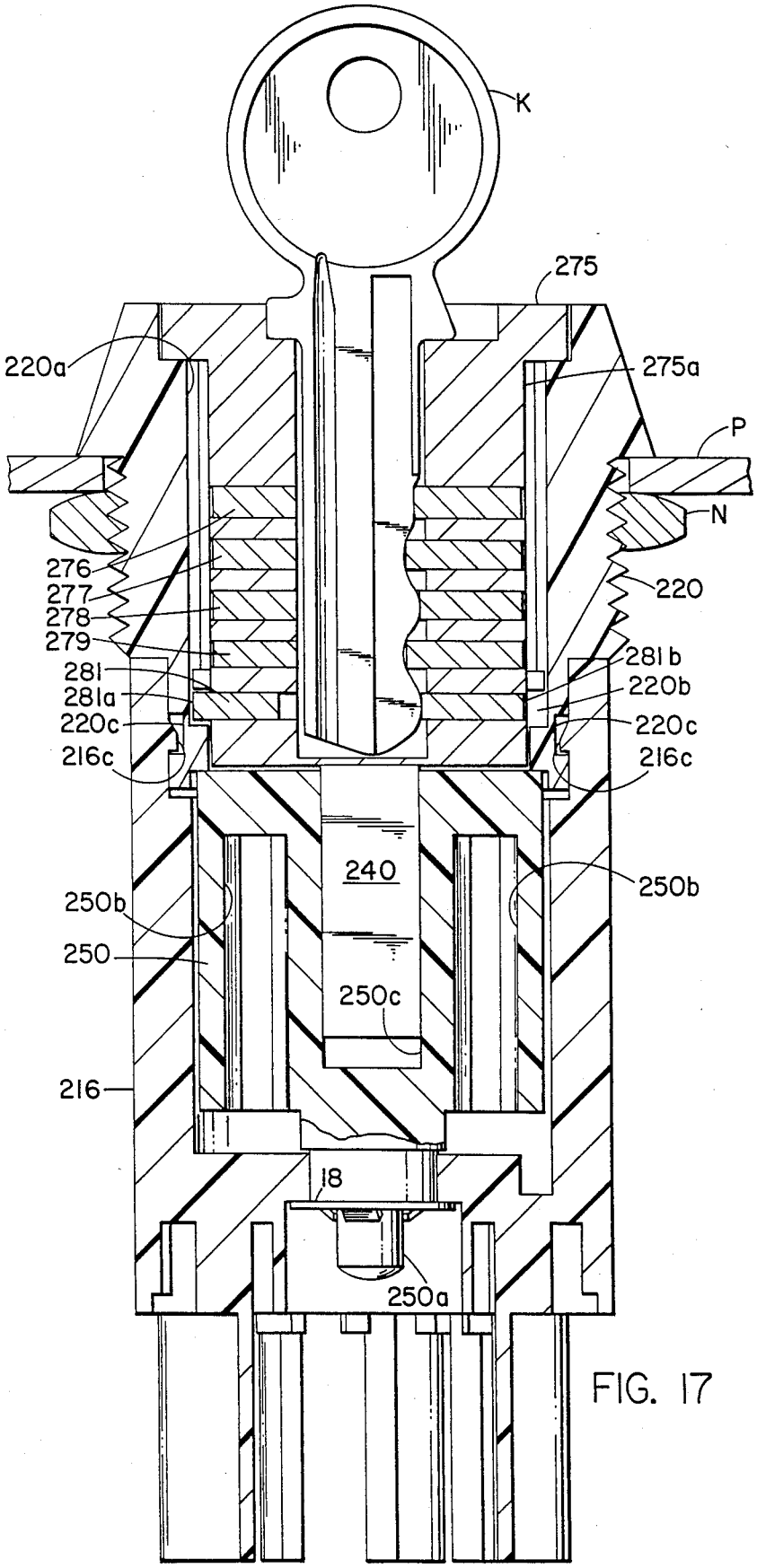
FIG. 17 shows a switch similar to that of FIG. 16 except that the upper cap portion of the body is adapted to be received in a panel opening from the front rather than from the rear of the panel, and so that the cap portion is adapted to receive a lock cylinder having a depending tang or cam for turning the rotary control member actuator only when the proper key is inserted in the cylinder lock and rotated.
Figure 22:
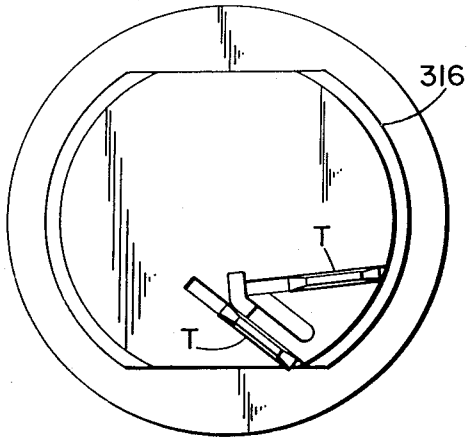
FIG. 22 is a bottom plan view of the switch illustrated in FIG. 18.
Figure 19:
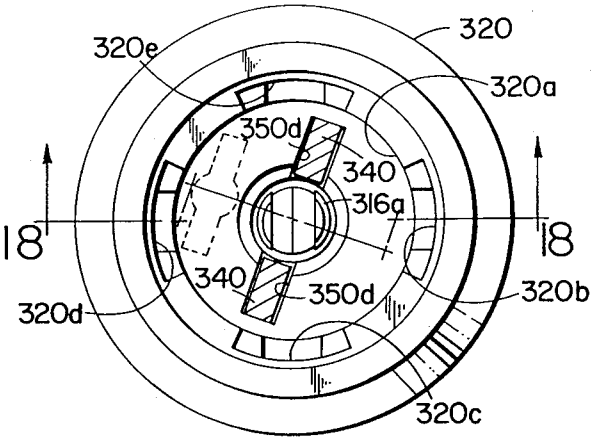
FIG. 19 is a horizontal section taken on the line 19—19 of FIG. 18.
Figure 21:
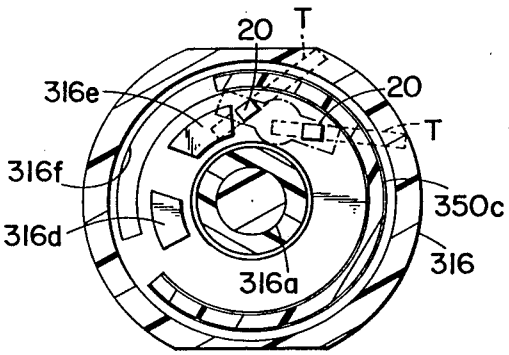
FIG. 21 is a view similar to FIG. 20 but showing the single pole switch in its "ON" condition.
Figure 20:
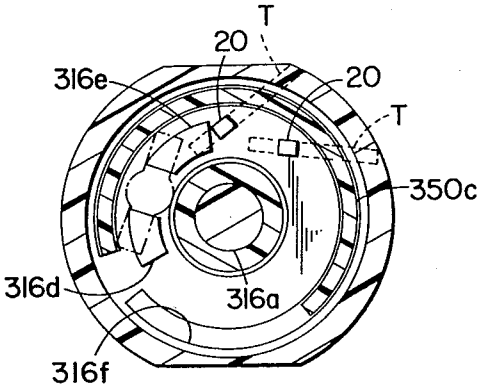
FIG. 20 is a horizontal section on the line 20—20 of FIG. 18 of FIG. 18.

FIG. 17 illustrates a key operated version of the rotary switch in my copending application wherein the upper or cap portion of the housing is provided with a receptacle for receiving a conventional disc tumbler lock cylinder mechanism. That is, a lock cylinder plug is provided for selective rotation in the cap portion of the switch case housing by means of a suitably configured key. It is a feature of my prior copending application as well as the subject application that the innermost or bottom wafer in the lock cylinder is not shifted by the key but remains in its biased position to provide a convenient means for securing the lock cylinder in the switch case cap portion. For this purpose the inside wall of the lock cylinder receptacle defines an annular slot that receives this innermost wafer as best shown in FIG. 17 of my copending application. The opposite end of this wafer is somewhat smaller than the end shown in the slot and is adapted to pass through a small gap in the upper slot in the side wall of the lock cylinder receptacle in order to allow assembly (or disassembly) of the lock cylinder from the switch case housing. The configuration for the lock cylinder with several such wafers operable either by a conventional key or by a master key to permit assembly and disassembly all as described in my identified copending application is conventional and such lock cylinders are available from several manufacturers including ESP (Engineered Security Products) of Leominster, Mass. See for example the lock sold by that company under their Model No. 625. See the disclosure in issued U.S. Pat. No. 4,748,297 for a complete description of this view as incorporated by reference herein.

DETAILED DESCRIPTION OF FIGS. 18–22

The key switch of FIGS. 18–22 like that of FIG. 17 is key operated with a lock cylinder provided in an upper or cap portion of the switch case housing.

It will be noted however that the actuator has no depending post such as that shown in FIG. 17 but instead defines a central bore adapted to receive an upstanding post provided integrally with the bottom wall of the switch case body portion itself.

The embodiment illustrated in FIGS. 22–30 is similar to that of FIGS. 18–22 in that the same general means is provided for securing the control member/actuator to the switch case body portion. More particularly in still with reference to the embodiment of FIGS. 18–22 the post is provided with a circumferentially extending slot for rotatably supporting an annular flange which extends radially inwardly from the bore defined in the actuator. The post has radially deformable portions that deflect at assembly and the annular flange cooperates with the above mentioned slot to retain these parts against axial movement while permitting relative rotational movement therebetween.

Stop means is provided for limiting relative rotation of the control member/actuator and the switch case body portion, but in this embodiment the stop means is defined between the lower end of the actuator and the bottom wall of the switch case itself. In the improved embodiment to be described such stop means is defined between the actuator and the upper or cap portion of the switch case housing so as to afford greater rigidity when the improved rotary switch is mounted in a panel opening. Another advantage of the embodiment to be described can be contributed to the bezel construction wherein any one of several bezels can be provided on the cap portion of the switch case housing so as to coordinate the external appearance of the switch with the customers requirements. See the disclosure in U.S. Pat. No. 4,748,297 for a complete description of these views as incorporated by reference herein.

DETAILED DESCRIPTION OF FIGS. 23–30

The rotary switch of FIGS. 23–30 like that of FIGS. 18–22 is key operated and has a lock cylinder 375 substantially identical to that provided in FIGS. 18–22 inclusively. An actuator or control member 450 is rotatably received in the upwardly open cylindrical cavity **416*c* defined by the body portion 416. Actuator 450 also includes a central bore or opening 450*a* that includes a lower portion adapted to receive an upstanding post 416*a* provided integrally with the bottom wall 416*b* of his body portion 416. This post 416*a* is formed much like the post 316*a* of the embodiment illustrated in FIGS. 18–22 in that it includes a circumferentially extending slot 416*g* that serves to rotatably support an annular flange 450*g* defined by the inner wall of the actuator 450*a*. More particularly the post 416*a* has an upper end defining radially deformable post portions the deflect inwardly at assembly and assume the assembled position shown after assembly. As so constructed the actuator/control member 450** from axial disassembly once these components are so assembled.

At least one downwardly open recess **450*b* is provided in the actuator 450 to slidably and rotatably receive the movable contact disc (not shown) and to also receive its associated individual spring biasing means and contact disc retainer (not shown). The bottom wall of the switch case cavity defines a plurality of circumaxially spaced openings for receiving a number of fixed contacts which fixed contacts have their upper ends adapted to be engaged by peripheral portions of the movable contact disc all as described and shown in my above-identified copending patent application. Three such fixed contacts are provided adjacent one another in FIG. 24 and the contact disc 10 is shown creating a closed circuit condition for two adjacent fixed contacts 20, 20**.

As so constructed and arranged rotation of the lock cylinder 375 by a key, such as that indicated generally at K at FIG. 23, causes corresponding rotational movement of the actuator 450 to achieve rotational movement of the movable contact disc 10 relative the longitudinal axis of the switch case and to achieve some vertical motion of the contact disc in its downwardly open recess as the disc rides over the top of each of the fixed contact upper ends. The lock cylinder 375 includes at least one depending cam or tang such as that illustrated at 340 in FIG. 23 and preferably two such tangs are provided on opposite sides of the center line of the lock cylinder and actuator as best shown in FIG. 25. These tangs or cams are received in correspondingly shaped slots or openings provided for them in the actuator or control member 450.

Finally, the switch case housing of FIG. 23 not only includes the body portion 416 but also includes an upper or cap portion 420 and these housing parts are assembled with one another by means defined in part by the cap portion and in part by the lower body portion and more particularly by telescopically received segments thereof all as shown and described in my above-identified copending application. As shown the upper cap portion 420 is slidably received inside the lower body portion 450 and circumaxially spaced projections are provided on the outside of the telescoped cap segment so as to be received in circumaxially spaced openings in the outer telescoped body segment associated therewith. It will be apparent that these components of this connection could be reversed such that the cap portion is provided outside the lower body segment and it will also be apparent that the segment projections might be reversed as well.

In accordance with the present invention I prefer to provide the stop means for the rotary actuator/control member between it and the upper cap portion since it is the cap portion that is ultimately mounted in the panel opening as suggested in FIG. 23. This location for the stop means provides greater strength for reacting the twisting torque exerted by the switch user back to the panel itself. Such stop means is indicated generally at **450*j* in FIG. 23 with the associated groove or slot provided in the upper cap portion of the housing being illustrated generally at 420*j***. As in the previously described embodiments such stop means may be configured to permit a predetermined angular travel for the actuator or control member about the longitudinal axis of the switch case.

In further accordance with the present invention a removable bezel B is threadably received on the upper end portion of the cap 420 and this bezel B defines the downwardly facing flange that cooperates with the panel P to permit the switch housing to be secured in a panel opening by means of a nut threadably received on the cap portion as shown. This construction permits any one of several bezels B to be selected for a particular installation in order to coordinate the appearance of the key operated switch with a particular panel decor. Not only can the color of the bezel B be varied for this purpose but so too its shape can also be varied as can the material from which the bezel B is fabricated. The lock cylinder 375 will generally be metal and the bezel B may also be made of metal or color coordinated with the metal lock cylinder without requiring the cap portion or shell for the lock cylinder 420 to be fabricated from metal. Therefore, the switch housing including the lower body portion and the upper cap portion can conveniently be fabricated from a suitable dielectric plastic material while given the appearance from the exterior of the panel that the entire assembly is fabricated from metal material.

In order to create the momentary action for a rotary switch of the type shown and described herein. I provide a torsion spring biasing means in the central bore or opening of the control member/actuator. The torsion spring is illustrate in some detail in FIGS. 26–29 and includes an upper coiled body portion 500 and opposed ends, one of which defines a depending leg 502.

The torsion spring lower end 502 is slidably received in a slot 416*k* provided for it in post 416*a*. See FIG. 30. The spring is inserted in this post only after first assembling the actuator/control member 450 with the body portion 416. Thus, the radially outwardly projecting opposite end 504 of the torsion spring can be conveniently placed into an upwardly open groove provided for it in the top of the control member/actuator 450. The body portion 500 of the spring of FIGS. 26–30 fits within the confines of the central bore or opening 450*a* of the control member 450 as best shown in FIGS. 23 and 25. As so configured the control member 450 and the spring must be assembled with the body portion 416 in a predetermined angular relationship. An arrow 503 is provided on the control member for alignment with an index 505 on the body portion to assure that the proper angular relationship is achieved at assembly.

It will be apparent that the modifications described with reference to FIGS. 23–30 can be incorporated in the embodiments described and shown in my copending application incorporated by reference herein. For example, the mounting switch action achieved by the torsion spring of FIGS. 26–30 can also be provided in a manually operable rotary switch such as that shown in FIGS. 1–14. Some modification to the spring itself would be required to permit both opposed ends to be inserted in slots such as provided in the FIG. 23 switch for the end 502. More specifically, the spring upper end 504 would preferably have an upwardly projecting portion configured in much the same manner as the depending lower portion 502. Such a spring end portion would preferably be received in a downwardly open recess provided on or near the longitudinal axis of rotation for the actuator (rather than radially as shown for the control member/actuator of FIG. 23). The actuator for use with such a spring would preferably be of one-piece plastic and have a downwardly open central bore to receive both the post and this modified torsion spring.

Figure 18:
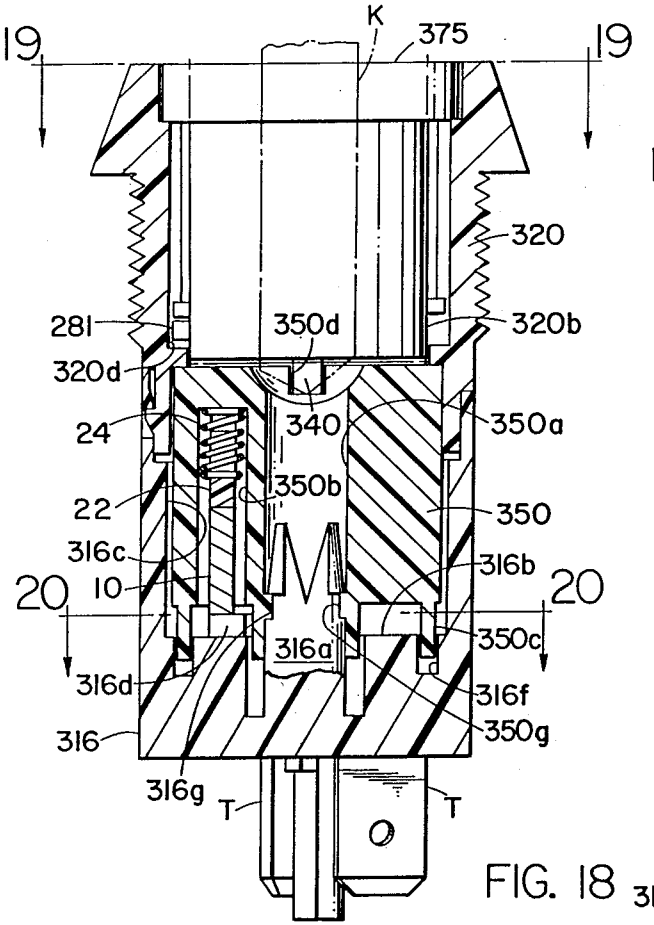
FIG. 18 shows a single pole ON/OFF key switch similar to that of FIG. 17 except for the more compact configuration for securing the lock cylinder in place and coupling it to the rotary actuator or control member, and but for the geometry of the restraining means to prevent axial movement of the actuator. The switch "OFF" condition is shown.

Alternatively, the actuator could be constructed in two parts, one of which parts would be substantially similar to the control member 450 of FIG. 23 and the other of which parts would be coupled to the upper end thereof by suitable means such as sonic welding or by the telescopic connection provided for between the housing portions of FIGS. 18 and 23 for example.

The separable bezel feature of FIG. 23 is also adaptable in the switch of FIGS. 1–14. The relocated stop means of FIG. 23 is best suited for use in a key lock switch such as shown in FIGS. 18–22 and in FIGS. 23–30. That is, in a rotary switch with a two part case or housing. The greater structural strength provided by defining the stop means in the same part used to mount the switch in the panel is the reason for relocating the stop means as shown in FIG. 23. However this feature is also useful in any two-piece switch housing. For example this feature will also benefit the switch of FIG. 17.

We claim:

1. A rotary switch comprising a generally cylindrical dielectric body portion defining an upwardly open cavity of generally cylindrical shape, said cavity having a cylindrical wall and a longitudinal central axis, said body portion having a bottom wall defining a plurality of circumaxially spaced openings, fixed contacts provided in at least some of said openings such that upper ends thereof are located between said cavity axis and the cylindrical cavity wall, a generally cylindrical dielectric control member rotatably received in said cylindrical cavity, means for restraining said control member from movement axially in said cavity, said control member having at least one downwardly open recess spaced radially from said cavity axis the same distance as that for said fixed contact upper ends, a movable contact in said recess, means in said recess for biasing said movable contact downwardly toward said fixed contact upper ends, said bottom cavity wall having a contour that cooperates with said fixed contact upper ends to permit said movable contact to close adjacent fixed contacts in response to angular rotational movement of said control member, and torsion spring biasing means provided in a spring opening defined in part by said control member and in part by said body portion, said torsion spring means biasing said control member toward a predetermined angular position so that the rotary switch exhibits a momentary action as the control member is rotated from said predetermined position to close said adjacent fixed contacts.

2. The switch of claim 1 wherein said means for restraining said control member comprises an upstanding post provided in said bottom wall of said body portion and received in a bore defined in said control member, and said post having radially deformable post portions engageable with an inwardly stepped side wall flange of said bore.

3. The switch of claim 2 wherein said spring opening of said control member communicates with and is defined in part by said bore for said post, said post defining an upwardly open slot, and said torsion spring having one end provided in said slot.

4. The switch of claim 3 wherein said torsion spring biasing means has a body portion of coiled wire configuration and said spring body portion provided in said control member bore above said post, and said torsion spring having an opposite end received in a radial slot defined by said control member.

5. The switch of claim 1 further characterized by an upper cap portion for said body portion, said cap portion having an opening for receiving said control member, means defined in part by said cap portion and in part by said body portion for holding said portions in assembled relation.

6. The switch of claim 5 further characterized by stop means for preventing rotation of said control member beyond an angular limit position, said stop means defined in part by said cap portion and in part by said control member.

7. The switch of claim 5 wherein said control member has an upper driven end rotatably received in said cap portion opening, said cap portion also defining a centrally located lock cylinder receptacle, a lock cylinder releasably secured in said receptacle and selectively rotatable therein by a particular key associated with a particular lock cylinder, and coupling means between said lock cylinder and said control member driven end to rotate the control member in response to said selective rotation of said lock cylinder.

8. The switch of claim 7 wherein said cap portion further includes a bezel portion releasably secured to the upper ends of said cap portion, said bezel portion defining a downwardly facing flange for abutting a panel where the switch is provided in a panel opening.

9. The switch of claim 8 wherein said bezel portion is selected from among several bezels of different configurations and from different material to permit use of one switch with any one of several different bezels.

10. The switch of claim 7 wherein said lock cylinder includes tumblers and wherein said receptacle has at least two axially extending slots for receiving said lock cylinder tumblers to prevent rotation of said lock cylinder except when fitted with said particular key.

11. The switch of claim 7 wherein said lock cylinder has at least one projecting tang, said coupling means comprising at least one upwardly open tang slot for receiving said projecting tang, and means for axially retaining said lock cylinder in said receptacle.

12. The switch of claim 7 wherein said lock cylinder has at least one projecting portion normally received in an annular slot provided for it in said lock cylinder receptacle side wall, whereby rotation of said lock cylinder can be achieved when fitted with said particular key, said lock cylinder projecting portion being retractable radially with a master key to provide said releasably secured lock cylinder and receptacle feature.

13. The switch of claim 5 wherein said means for restraining said control member comprises an upstanding post provided in said bottom wall of said body portion and received in a bore defined in said control member, and said post having radially deformable post portions engageable with an inwardly stepped side wall flange of said bore.

14. The switch of claim 13 wherein said spring opening of said control member communicates with and is defined in part by said bore for said post, said post defining an upwardly open slot, and said torsion spring having one end provided in said slot.

15. The switch of claim 14 wherein said torsion spring biasing means has a body portion of coiled wire configuration and said spring body portion provided in said control member bore above said post, and said torsion spring having an opposite end received in a radial slot defined by said control member.

16. The switch of claim 15 further characterized by stop means for preventing rotation of said control member beyond an angular limit position, said stop means defined in part by said cap portion and in part by said control member.

17. The switch of claim 15 wherein said control member has an upper driven end rotatably received in said cap portion opening, said cap portion also defining a centrally located lock cylinder receptacle, a lock cylinder releasably secured in said receptacle and selectively rotatable therein by a particular key associated with a particular lock cylinder, and coupling means between said lock cylinder and said control member driven end to rotate the control member in response to said selective rotation of said lock cylinder.

18. The switch of claim 17 wherein said cap portion further includes a bezel portion releasably secured to the upper ends of said cap portion, said bezel portion defining a downwardly facing flange for abutting a panel where the switch is provided in a panel opening.

19. The switch of claim 17 wherein said lock cylinder includes tumblers and wherein said receptacle has at least two axially extending slots for receiving said lock cylinder tumblers to prevent rotation of said lock cylinder except when fitted with said particular key.

20. The switch of claim 17 wherein said lock cylinder has at least one projecting tang, said coupling means comprising at least one upwardly open tang slot for receiving said projecting tang, and means for axially retaining said lock cylinder in said receptacle.

21. The switch of claim 17 wherein said lock cylinder has at least one projecting portion normally received in an annular slot provided for it in said lock cylinder receptacle side wall, whereby rotation of said lock cylinder can be achieved when fitted with said particular key, said lock cylinder projecting portion being retractable radially with a master key to provide said releasably secured lock cylinder and receptacle feature.

22. The switch of claim 1 wherein said movable contact comprises a conductive disc disposed in said control member recess for rolling movement across the upper ends of said fixed contacts so that its periphery engages said upper ends.

23. The switch of claim 22 wherein said means for biasing said movable contact disc comprises a retainer also slidably received for transmission in said recess and having a concave lower surface for engaging another portion of said disc periphery opposite said first mentioned portion, and a compression spring also provided in said recess and acting on said retainer to urge it and said contact disc toward said fixed contact upper ends.

24. The switch of claim 22 wherein said means for restraining said control member comprises an upstanding post provided in said bottom wall of said body portion and received in a bore defined in said control member, and said post having radially deformable post portions engageable with an inwardly stepped side wall flange of said bore.

25. The switch of claim 24 wherein said spring opening of said control member communicates with and is defined in part by said bore for said post, said post defining an upwardly open slot, and said torsion spring having one end provided in said slot.

26. The switch of claim 25 wherein said torsion spring has a body portion of coiled wire configuration and said spring body portion provided in said control member bore above said post, and said torsion spring having an opposite end received in a radial slot defined by said control member.

27. The switch of claim 26 further characterized by an upper cap portion for said body portion, means defined in part by said cap portion and in part by said body portion for holding said portions in assembled relation, said cap portion having an opening for receiving a portion of said control member.

28. The switch of claim 27 further characterized by stop means for preventing rotation of said control member beyond an angular limit position, said stop means defined in part by said cap portion and in part by said control member.

29. The switch of claim 28 wherein said control member has an upper driven end rotatably received in said cap portion opening, said cap portion also defining a centrally located lock cylinder receptacle, a lock cylinder releasably secured in said receptacle and selectively rotatable therein by a particular key associated with a particular lock cylinder, and coupling means between said lock cylinder and said control member driven end to rotate the control member in response to said selective rotation of said lock cylinder.

30. The switch of claim 29 wherein said cap portion further includes a bezel portion releasably secured to the upper ends of said cap portion, said bezel portion defining a downwardly facing flange for abutting a panel where the switch is provided in a panel opening.

31. The switch of claim 30 wherein said bezel portion is selected from among several bezels of different configurations and from different materials to permit use of one switch with any one of several different bezels.

32. The switch of claim 28 wherein said lock cylinder includes tumblers and wherein said receptacle has at least two axially extending slots for receiving said lock cylinder tumblers to prevent rotation of said lock cylinder except when fitted with said particular key.

33. The switch of claim 28 wherein said lock cylinder has at least one projecting tang, said coupling means comprising at least one upwardly open tang slot for receiving said projecting tang, and means for axially retaining said lock cylinder in said receptacle.

34. The switch of claim 28 wherein said lock cylinder has at least one projecting portion normally received in an annular slot provided for it in said lock cylinder receptacle side wall, whereby rotation of said lock cylinder can be achieved when fitted with said particular key, said lock cylinder projecting portion being retractable radially with a master key to provide said releasably secured lock cylinder and receptacle feature.

35. In a rotary key operated electric switch having a lower body portion defining a cavity for rotatably receiving a control member for moving a rolling contact across the upper ends of adjacent circumaxially spaced fixed contacts, and wherein a lock cylinder is rotatably supported in a cap portion that is secured to the body portion so that rotation of the lock cylinder also rotates the control member, the improvement comprising a bezel portion releasably secured to the upper end of said cap portion, said bezel portion defining a downwardly facing flange for abutting a panel when the switch is provided in a panel opening, means for releasably securing the lock cylinder in said cap portion, said lock cylinder securing means comprising a projecting portion of said lock cylinder normally received in an annular slot therefore and a lock cylinder receptacle defined by said cap portion, means for coupling said lock cylinder with said control member for rotational movement therewith, and means for restricting said control member from movement axially in said cavity, said control member restricting means comprising an upstanding post provided in a bottom wall of said body portion, said post received in a central bore defined by said control member and having radially deformable post portions engageable with an inwardly stepped side wall flange of said bore.

* * * * *